US005881645A

United States Patent [19]

Lenney et al.

[11] Patent Number: 5,881,645

[45] Date of Patent: Mar. 16, 1999

[54] METHOD OF THERMALLY SPRAYING A LITHOGRAPHIC SUBSTRATE WITH A PARTICULATE MATERIAL

[76] Inventors: John Richard Lenney, Willowbeck, 11 Hazel Drive, Burn Bridge, Harrogate HG3 1NY; Robert Michael Organ, Flat 4, 11 Blenheim Road, St Johns, Wakefield, West Yorkshire WF1 3JZ, both of Great Britain

[21] Appl. No.: 782,522

[22] Filed: Jan. 10, 1997

Related U.S. Application Data

[63] Continuation of Ser. No. 397,153, filed as PCT/GB93/01910, Sep. 9, 1993, abandoned.

[30] Foreign Application Priority Data

| | | | |
|---|---|---|---|
| Sep. 10, 1992 | [GB] | United Kingdom | 9219214 |
| Apr. 21, 1993 | [GB] | United Kingdom | 9308182 |

[51] Int. Cl.[6] ..... C23C 4/10; B41N 1/08

[52] U.S. Cl. ..... 101/463.1; 101/458; 427/453

[58] Field of Search ..... 101/454, 456, 101/458, 459, 463.1, 465, 467; 427/453

[56] References Cited

U.S. PATENT DOCUMENTS

| | | | |
|---|---|---|---|
| 2,032,770 | 3/1936 | Rowell | 101/401 |
| 2,032,779 | 3/1936 | Wescott | 101/401 |
| 3,511,661 | 5/1970 | Rauner et al. | 101/459 |
| 3,742,585 | 7/1973 | Wentzell | 29/423 |
| 3,839,618 | 10/1974 | Muehlberger | 219/121 P |
| 3,871,881 | 3/1975 | Mikelsons | 430/60 |
| 4,301,730 | 11/1981 | Heurich et al. | 101/483 |
| 4,328,257 | 5/1982 | Muehlberger et al. | 427/34 |
| 4,391,879 | 7/1983 | Fabian et al. | 428/551 |
| 4,507,383 | 3/1985 | Tsuruta et al. | 430/275 |
| 4,526,839 | 7/1985 | Herman et al. | 428/550 |
| 4,596,189 | 6/1986 | Halpern et al. | 101/458 |
| 4,912,824 | 4/1990 | Baran | 101/348 |
| 4,932,319 | 6/1990 | Switall | 101/147 |
| 4,991,501 | 2/1991 | Yokoyama et al. | 101/148 |
| 5,093,180 | 3/1992 | Morgan | 101/328 |
| 5,332,601 | 7/1994 | Varacalle, Jr. et al. | 427/452 |
| 5,382,964 | 1/1995 | Schneider | 101/467 |

FOREIGN PATENT DOCUMENTS

| | | |
|---|---|---|
| 223104 | 10/1986 | European Pat. Off. . |
| 2120899 | 8/1972 | France . |
| 3721008 | 6/1987 | Germany . |
| 126412 | 6/1928 | Switzerland . |
| 208963 | 6/1940 | Switzerland . |
| 2244064 | 11/1991 | United Kingdom . |
| WO 94/05507 | 3/1994 | WIPO . |

OTHER PUBLICATIONS

Scharwachter, R., "Technik Und Anwendung Des Plasmaspritzen Im Vakuum", *Wt Zeitschrift Fur Industriele Fertigung*, vol. 67, pp. 321–325 (1977), Muchen, DE; and translation thereof.

Wolf, Philip C. "Neue Anwendungsgebiete Des Plasmaspritzens In Der Energietechnik", *Warme*, vol. 89., No. 3, pp. 42–45, Grafeling, DE (Jun. 1983); and translation thereof.

*Primary Examiner*—Stephen R. Funk

*Attorney, Agent, or Firm*—Ostrager Chong Flaherty & Onofrio

[57] ABSTRACT

A method of making a light sensitive printing plate such as might be used in lithography, comprises creating a surface layer on substrate base material by depositing particulate coating material on the base material using a dry deposition technique, the surface layer being formed from particles whose size is less than about 15 $\mu$m, and creating an image layer on the deposited surface layer so that the surface layer is located intermediate the base material and the image layers.

33 Claims, 1 Drawing Sheet

METHOD OF THERMALLY SPRAYING A LITHOGRAPHIC SUBSTRATE WITH A PARTICULATE MATERIAL

This application is a continuation of Ser. No. 08/397,153, filed on Apr. 14, 1995, now abandoned, which is a 371 of PCT/GB93/01910, filed on Sep. 9, 1993.

FIELD OF THE INVENTION

This invention relates to a light sensitive printing plate and to a method of making a printing plate. Such plates might be used, for example, in lithographic printing processes.

BACKGROUND OF THE INVENTION

Lithographic processes involve establishing image (printing) and non-image (non-printing) areas on a substrate, substantially on a common plane. When such processes are used in the printing industries, non-image areas are generally hydrophilic, and image areas are generally oleophilic. Consequently, oil based inks are repelled from the non-image areas after water has been applied to the substrate.

Image and non-image areas can be created by processes which include a step of exposing a layer of image material on the surface of the substrate to radiation. The exposure to radiation creates solubility differences in the image material corresponding to image and non-image areas. Following development, the soluble areas are removed, leaving a pattern on the substrate corresponding to the image.

Preparation of the substrate for receiving a layer of the image material must ensure that the material bonds to the substrate, at least prior to image formation. However, it must allow release of the soluble image material after development.

Suitable image materials for use in lithographic processes can include those based on diazonium/diazide materials, polymers which undergo depolymerization or addition photo-polymerization, and silver halide gelatin assemblies. Examples of suitable materials are disclosed in GB-1592281, GB-A-2031442, GB-A-2069164, GB-A-2080964, GB-A2109573 and EP-A-377589.

Substrates used in the printing industry commonly comprise an aluminum base layer, which has a layer of aluminum oxide on its surface, intermediate the base material and a subsequently applied image layer, resulting from a controlled oxidation reaction conducted electrochemically. Prior to the oxidation reaction, the surface of the aluminum base layer is subjected to a cleaning treatment, for example involving washing with alkali. The base layer is then subjected to a texture control treatment, for example involving an etching process, which increases the surface area of the substrate, which in turn controls the strength of the bond between the substrate and the image material and increases the ability of the substrate to hold water. It can be appropriate in some circumstances to modify the characteristics of the surface coating of aluminum oxide in order to ensure that the strength of the bond between the surface and the subsequently applied image layer is appropriate, both in the regions which are to remain bonded to the oxide coating and in the regions which are to be removed. This treatment can involve treatment with water, a solution of a phosphate or silicate salt, or a polycarboxylic acid.

A problem with this known process for preparing substrates for use in lithographic processes with an aluminum base layer, is that it uses a significant amount of energy in the course of the steps by which the base layer is etched and then oxidized. There can also be significant consumption of materials for cleaning and etching the surface of the substrate prior to oxidation, which gives rise to expense both in terms of the materials themselves and of subsequent disposal of the used materials.

GB-1238701, published in 1971, discloses a process for preparing a lithographic printing plate in which a surface of a foil such as of aluminum is subjected to a uniform treatment with a plasma arc jet. Finely dispersed silica introduced into the jet causes a layer of silicate to be formed on the surface of the foil. The process disclosed in the document does not appear to have been used commercially to produce plates.

Substrates used in lithography can also be formed from materials other than aluminum, such as for example, another metal such as steel, a polymeric material such as a polyester, or a paper based material. Processes used to prepare such substrates for coating with light sensitive material vary widely from that used to prepare an aluminum substrate.

SUMMARY OF THE INVENTION

The present invention provides a technique for making light sensitive printing plates such as might be used in lithographic processes, in which a surface coating is provided on a substrate by a dry deposition technique, especially by a thermal spraying technique.

Accordingly, in one aspect, the invention provides a method of making a light sensitive printing plate for use in lithography, which comprises: (a) creating a surface layer on substrate base material by depositing particulate coating material on the base material using a dry deposition technique, the surface layer being provided by particles whose size is less than about 15 $\mu$m; and (b) creating an image layer on the deposited surface layer so that the surface layer is located intermediate the base material and the image layer.

Surprisingly, it has been found that, by controlling the size of the particles of the material from which the surface layer is formed, a plate can be formed in which performance is at least as good in many respects as that provided by traditional manufacturing methods which are used now and have been developed by parties across the lithographic products industry continuously over a period of many years.

The technique of the invention has the advantage over traditional methods that the surface layer can be provided, of materials and having a structure which are dependent on the process by which it is applied to the substrate. This can be contrasted with existing processes in which a surface layer is created by modification of the base material of the substrate to create a surface layer with different properties, in which the material and structure of the surface layer of the substrate are dependent on the material and surface of the base material, in addition to the process used to create the surface layer. The invention therefore allows the steps in a process for preparing a substrate, of base material preparation and creation of a surface layer, effectively to be decoupled.

The use of a deposition technique has the additional advantage over traditional methods of making lithographic printing plates that the number of steps in the manufacturing process can be reduced. In particular, the path length i.e. the size of the active process area acting on the web of substrate material is considerably shorter when a dry deposition technique is used, compared with traditional methods using electrochemical processing techniques. Consequently, the amount of substrate material that is wasted when equipment used to operate the method of the invention is started can be reduced considerably. The reduced number of process steps, or the reduced path length or both, can reduce capital outlay, both in terms of manufacturing equipment and of space in which that equipment is operated. A process involving fewer steps is also easier to control to produce products with a consistent quality. It can also be arranged for the process to be operated more quickly than conventional processes.

DESCRIPTION OF THE PREFERRED EMBODIMENTS

Figure 1:
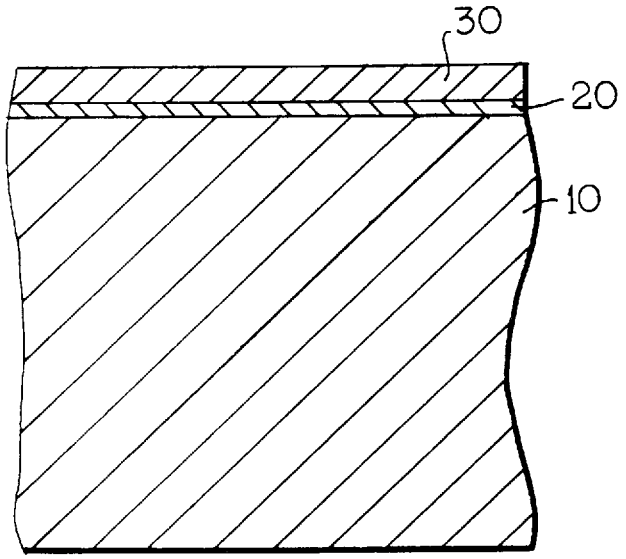
FIG. 1 is cross-sectional view of a printing plate in accordance with the invention.

Deposition techniques used for providing the surface layer of a substrate can produce a layer with a topology appropriate for bonding to it of a layer of image material, without separate etching or other texture control steps as are required in known aluminum substrate preparation processes. Moreover, the topology of the surface of the substrate can be controlled relatively easily by adapting the parameters of the deposition process, giving the process of the invention greater flexibility and control than could be achieved in the conventional processes of producing printing plates.

Furthermore, the creation of the surface layer from deposited material, rather than from the base material of the substrate, makes less critical the selection of the base material of the substrate. For example, when the base material comprises a metal such as one based on aluminum, a less pure grade of aluminum can be used than would be required if a surface layer of aluminum oxide were to be formed on the base material by oxidation of the base material. The requirement for thorough cleaning of the base material of a substrate can also be relaxed at least partially, removing or reducing the need for cleaning materials and reducing processing time, and removing or diminishing the problem of disposal of used cleaning materials. In this way, the costs of producing printing plates can be reduced by the method of the present invention.

A further advantage of the use of a deposition technique for the manufacture of a plate, at least for certain combinations of substrate base material and coating material (such as an aluminum oxide based coating material deposited on aluminum base material) is that the lightness of the resulting plate can be higher than that of a plate made using the same material for the surface layer but by traditional techniques. This has the advantage that it can increase the contrast between the plate and an image on the plate, which can be important when assessing the image visually and when the image on the plate is to be optically scanned.

FIG. 1 shows a printing plate in accordance with a preferred embodiment of the invention. The plate comprises a substrate base material layer 10, a surface layer 20 formed by depositing a particulate coating material on the substrate layer 10 using a dry deposition technique, and an image layer 30. Suitable dry deposition techniques include thermal spraying and sputtering. An example of thermal spraying techniques which might be applied includes flame spraying. It is particularly preferred that the process uses a plasma spraying technique.

When the deposition process employs a plasma spraying technique, it will generally be preferred for the spray to be applied in an atmosphere of an inert gas, for example of hydrogen, nitrogen or argon, or mixtures of these or other gases. The gas is heated in an electric arc to elevated temperature, for example of at least $10^{4\circ}$ C., generally at least $2\times10^{4\circ}$ C. Notwithstanding the energy requirement of the electric arc, it has been found that the power required to operate the deposition process using a gas plasma spraying technique is significantly less than that required to operate the electrochemical technique in the conventional process for producing plates for use in the printing industry.

When the deposition step involves use of a thermal spraying technique, it can be preferred during the deposition step to maintain the substrate base material in contact with a heat sink. When the base material comprises a metal, especially aluminum, the deposition technique and the heat sink properties are such that the temperature of the base material does not increase to the extent that the base material becomes annealed. For example, the substrate base material might be maintained in close contact with a block of material with a high thermal mass, such as a relatively large block of a metallic material.

Preferably, the surface layer is formed from particles whose size is less than about 12 $\mu$m, more preferably less than about 8 $\mu$m, especially less than about 5 $\mu$m, for example from about 2 $\mu$m to about 3 $\mu$m. As the particle size is reduced, the roughness of the deposited surface layer can be maintained low. Surprisingly, it has been found that plates made by the technique of the present invention can provide better image resolution than plates made by traditional techniques even when, because particles towards the upper end of the size range are used, the surface of the plates is rougher.

The size of the particles is measured using a Coulter counter, calibrated to U S Sedimentometer. The size is the average of the particles across the size distribution, taken as the 50% cumulative point of the distribution curve.

It has been found preferable to provide means for supplying a gas directly to the powder feed unit of the thermal spraying unit. It has been found that this can enhance flow of powder from the unit, minimizing blockages in the powder outlet from the feed unit.

A further advantage of plates made using the technique of the present invention is that the resulting plates have a better run length, compared with plates made using traditional techniques with the same surface layer material and comparable image resolution. (Run length is a measure of the number of impressions that can be taken from a plate when in use in printing process.)

The surface layer that is formed from the small particles will be generally uniform over the coated area of the base material, as viewed for example under an electron microscope at about 1000× magnification and 45° tilt. The coating material used to form the surface layer will in some situations include particles whose size is bigger than that of the particles from which the surface layer is formed. For example, the coating material might include impurities. It might also include particles which are bigger than the particles of the surface layer, to form regions of local roughness on the substrate base material so that formations are formed on the surface of the image layer. Such particles might be, for example, at least about 1.3 times that of the particles from which the surface layer is formed, preferably at least about 1.8 times that of those particles. The height of the bigger particles above the surface layer might be at least about 3 $\mu$m, preferably at least about 5 $\mu$m, more preferably at least about 7 $\mu$m, especially at least about 10 $\mu$m. The height of the bigger particles above the surface layer might be less than about 40 μm, preferably less than about 30 μm, especially less than about 20 μm.

Preferably, the size of the bigger particles (which will be a diameter in the case of particles with a circular cross-section) is greater than about 5 μm, more preferably greater than about 7 μm, especially greater than about 10 μm. Preferably, the size is less than about 75 μm, more preferably less than about 50 μm, especially less than about 35 μm.

The density of bigger particles on the surface layer can be at least about 50 $cm^{-2}$, preferably at least about $10^3$ $cm^{-2}$, for example at least about $5\times10^4$ $cm^2$. The density of particles can be less than about $5\times10^6$ $cm^{-2}$, and preferably less than about $10^6$ $cm^{-2}$ for many applications.

Preferably, the deposited surface layer is formed from a material which is capable of exhibiting ceramic-type properties. Desirable properties can include hardness, chemical resistance, and resistance to abrasion. Such properties can arise from rapid solidification of the deposited material on contact with the base material of the substrate. The provision of a surface with ceramic-type properties has the advantage of enabling the substrate prepared from the deposited material to withstand harsh physical conditions during use. Examples of materials capable of forming surface layers on a substrate, with ceramic-type properties include certain silicates, $Al_2O_3$, $Cr_2O_3$, $TiO_2$, $ZrO_2$, WC and blends of these materials, such as blends of $Al_2O_3$ and $TiO_2$.

Other materials which can be applied to a substrate base material by deposition techniques, to form a substrate for use in lithography, include metals such as aluminum, molybdenum, nickel, tantalum, zinc and chromium, alloys such as NiCr and NiCrAlY alloys, steels and bronzes, pseudo-alloys such as CrW and AlMo alloys, polymeric materials such as polyethylene and certain polyesters.

The material of bigger particles included in the coating material to provide formations on the surface of the image layer can be the same as the material of the particles from which the surface layer is formed, or different.

More than one material might be applied to the base material by deposition, in a single layer or in separate layers provided one on top of another. The base material of substrate may comprise a metal, which might be a substantially pure elemental metal or an alloy. Suitable metals include, for example, iron based materials such as certain steels, copper and copper based alloys, nickel and cobalt alloys, and aluminum, magnesium and titanium and alloys based on these metals. Non-metallic materials might be used, such as ceramic materials, polymeric materials (such as certain polyesters) and paper based materials.

The method of the invention will include appropriate steps to prepare the base material for the creation of the surface by deposition. These might include, for example, cleaning, etching, texturing, anodizing, grinding or polishing of the surface.

Especially preferred materials for the base material of the substrate include aluminum and aluminum based alloys, certain steels and certain polyesters.

The substrate produced by the method will generally be in the form of a sheet. The sheet might be in discreet pieces, or in the form of a continuous web, perhaps provided on a roll. The substrate will generally be produced continuously on a sheet of moving substrate base material, by moving a sheet through production equipment. Preferably, the sheet has a width measured in a direction perpendicular to the machine direction of at least about 0.2 m, more preferably at least about 0.3 m, especially at least about 0.5 m.

The size and shape of particles supplied to the substrate in a thermal spraying process will be selected according to the desired surface topology of the finished coated substrate. The surface roughness R of the substrate can be measured using a perthometer sold by Perthen under the designation CSD, using a PMK drive unit and a FTK 3/50e mechanical stylus head. The surface roughness is preferably less than about 3.0 μm, more preferably less than about 1.5 μm, for example about 0.7 μm. It will be understood that the surface may be provided with selected regions with a greater roughness, for example as a result of use of bigger particles, for example giving a peak to valley distance on the surface of the substrate greater than about 3 μm, especially greater than about 5 μm, perhaps in the range of 10 to 20 μm, and that any such regions are not to be considered in the context of measuring surface roughness.

The thickness of the surface layer which is deposited on the base material will generally be less than about 100 μm, preferably less than about 40 μm, more preferably less than about 20 μm, especially less than about 10 μm, frequently less than about 5 μm. The thickness will generally be greater than about 0.1 μm, preferably greater than about 0.5 μm, and may be greater than about 10 μm.

The layer of image material provided on the substrate may be provided over the entire surface of the layer of deposited material. In use of the substrate, the image layer might be exposed to a treatment which makes it relatively easier to remove in selected regions of the substrate than in other regions, in a subsequent removal step. In this event, the image material will generally form a bond initially to the surface layer of deposited material, at least in certain regions of the substrate, and will be capable of being modified to alter its susceptibility to a subsequent removal step. Examples of suitable developable materials of this kind include those based on diazonium/diazide materials, polymers which undergo depolymerisation or addition photopolymerization, and silver halide gelatin assemblies. Examples of suitable materials are disclosed in GB-1592281, GB-A-2031442, GB-A-2069164, GB-A-2080964, GB-A-2109573 and EP-A-377589.

Image material may be applied to a substrate in selected regions only, so as to define directly the image and non-image areas of the substrate directly. This might be achieved, for example, using suitably driven fluid jets.

The process of the invention can include steps by which the surface of the substrate is treated to change the nature of the interactions between it and a subsequently applied layer of image material. The steps can involve, for example, chemical, physical or electrochemical treatment. For example, the steps might involve treatment with a material, grinding and polishing and so on. The treatment can be physical or chemical (including electrochemical) in nature. For example, the deposited surface layer of material might be treated with water, a polyphosphonic acid, a solution of a phosphate or silicate salt, or with a polycarboxylic acid. Alternatively or in addition, a material for treating the surface of the substrate might be applied by a deposition technique.

The invention will now be described with reference to examples.

EXAMPLE 1

A substrate for use as a lithographic printing plate was made by plasma spraying $Al_2O_3$ powder on a 0.3 mm gauge aluminum alloy sheet of designation AA1050. The $Al_2O_3$ powder had a particle size of 3 μm, and was supplied by Abralap Limited under the trade name Abralox C3. An arrangement was used where the sheet was mounted vertically using a steel vacuum plate which also acted as a suitable heat sink. Spraying was carried out using a translational unit which allowed raster scanning of the plasma spraying torch about the plate at a fixed torch-plate distance.

The spraying system comprised units supplied by Plasma-Technik, including a control unit designated M1100C, a torch designated F400MB, and a powder feed unit designated Twin 10, which had been modified by introducing a pipe into the unit to allow a further flow of 10 $l.min^{-1}$ of argon above the powder (in addition to the standard carrier gas flow of 9 $l.min^{-1}$ of argon associated with the unmodified unit). It was necessary to dehydrate the powder prior to its introduction into the feed unit.

The following spray conditions were used to create the substrate:

| | |
|---|---|
| Primary plasma gas | Argon |
| Secondary plasma gas | Hydrogen |
| Primary gas flow | 40 $l.min^{-1}$ |
| Secondary gas flow | 8 $l.min^{-1}$ |
| Current | 550 A |
| Nozzle diameter | 7 mm |
| Nozzle-sheet distance | 65 mm |
| Powder injector position | 90° |
| Powder injector nozzle | 3 mm |
| Powder unit disc speed | 30% |
| Torch traverse speed | 60 $m.min^{-1}$ |
| Raster Steps | 5 mm |
| No. of passes/raster | 1 |

The substrate was used to produce a printing plate by (i) treatment with a solution of sodium dihydrogen phosphate, and (ii) bar coating in the laboratory with a light sensitive material of the type which is applied by Horsell Graphic Industries Limited to light sensitive lithographic printing plates sold by them under the trade mark CAPRICORN, at a coating weight of 2 $g.m^{-2}$.

EXAMPLE 2

Substrates for use as printing plates were made by plasma spraying the following range of aluminum alloy sheets with $Al_2O_3$ powder having a particle size of 5 $\mu$m, supplied by Abralap Limited under the trade name Abralox C5:

(a) AA1050 aluminum alloy.
(b) AA3103 aluminum alloy.
(c) AA3004 aluminum alloy.

The sheets were secured around a 200 mm diameter roller which acted as a heat sink. Spraying was performed by movement of the torch along the axis of the roller, as the roller rotated. The spraying system was the same as that described above in Example 1 (with some variations in the operating conditions), but for the powder feed unit being one without the additional flow of argon gas.

Printing plates were made from the substrates by the technique described above in Example 1, and were exposed through an UGRA test pattern. Each of the plates was found to provide satisfactory resolution performance, with no detectable differences between the plates.

EXAMPLE 3

A substrate was created using the apparatus and method described above in Example 2 (with some variations in the operating parameters of the spraying system), by spraying an AA1050 aluminum alloy sheet with $SiO_2$ powder having a particle size of 8 $\mu$m, sold by W. R. Grace Limited under the trade name Syloid Al-1.

A printing plate was made from the substrate by the technique described above in Example 1, and was exposed through a UGRA test pattern. The plate was found to provide satisfactory resolution performance.

EXAMPLE 4

Substrates were created using the apparatus and method described above in Example 1 (with some variations in the operating parameters of the spraying system), by spraying an AA1050 aluminum alloy sheet with $Al_2O_3$ powders having a range of particle sizes from 3 to 20 $\mu$m.

The substrates were used to produce printing plates as described above in Example 1, which were exposed through UGRA and STOUFFER test patterns, to create a clear 3 on the STOUFFER test pattern following development of the plates. The minimum "intact" positive microlines on the UGRA test pattern were examined at the clear 3 expose level as a measure of printing plate resolution. The results are summarized in Table 1, and compared favorably with the resolution of a plate that is produced by bar coating in the laboratory a conventional electrochemically produced substrate with a CAPRICORN type coating referred to above in Example 1, and which gave a resolution at "clear 3" of 20. The conventional electrochemically produced substrate used for the comparison was the same as is used on commercial production lines of CAPRICORN plates.

TABLE 1

| Powder Size ($\mu$m) | Resolution ($\mu$m) |
|---|---|
| 3.00 | 12.00 |
| 5.00 | 15.00 |
| 9.00 | 30.00 |
| 12.00 | 40.00 |
| 15.00 | 55.00 |
| 20.00 | 70.00 |
| CAPRICORN plate | 20.00 |

EXAMPLE 5

A substrate was created using the apparatus and method described above in Example 2 (with some variations in the operating parameters of the spraying system), by spraying an AA1050 aluminum alloy sheet with 1:1 mixture by weight of $Al_2O_3$ powders having particle sizes of 5 $\mu$m and 9 $\mu$m, sold by Abralap Limited under the trade names Abralox C5 and Abralox C9.

A printing plate was made from the substrate by the technique described above in Example 1, and was exposed through a STOUFFER test pattern and a 2% dot screen. Following development to produce a "clear 3", the press performance was compared with that of a plate produced by bar coating in the laboratory of a CAPRICORN type coating as referred to above, exposed and developed to the same level. Run length was assessed by the disappearance of the 2% dot screen. A summary of the results is shown in Table 2.

TABLE 2

| Test | Plasma Produced Plate | Traditional Plate |
|---|---|---|
| Roll-up | Comparable performance | |
| Clean-up | Comparable performance | |

TABLE 2-continued

| Test | Plasma Produced Plate | Traditional Plate |
|---|---|---|
| Ink-water balance | Comparable performance | |
| 2% dot disappearance | 270000 impressions | 168000 impressions |

It is claimed:

1. A method of making a light sensitive printing plate, which comprises:

(a) selecting a particulate coating material having particles of a size less than about 15 μm;

(b) creating a surface layer on a substrate base material layer by depositing the particulate coating material on the base material layer using a thermal spraying technique; and (c) creating an image layer on the deposited surface layer such that the surface layer is located intermediate the base material layer and the image layer.

2. A method as claimed in claim 1, wherein the surface layer is deposited on the base material layer by means of a plasma spraying process.

3. A method as claimed in claim 2, wherein the surface layer is deposited on the base material layer in an atmosphere of an inert gas.

4. A method as claimed in claim 3, wherein the inert gas is heated in an electric arc to an elevated temperature of at least $10^{4\circ}$ C.

5. A method as claimed in claim 1, wherein the particulate coating material is selected to have particles of a size less than about 12 μm.

6. A method as claimed in claim 1, wherein the particulate coating material is selected to have particles of a size less than about 8 μm.

7. A method as claimed in claim 1, wherein the particulate coating material is selected to have particles of a size less than about 5 μm.

8. A method as claimed in claim 1, wherein the particulate coating material is selected to have particles of a size from about 2 μm to about 3 μm.

9. A method as claimed in claim 1, wherein the base material layer is in the form of a sheet.

10. A method as claimed in claim 9, wherein the base material layer moves continuously in a first direction and has a width measured in a direction perpendicular to the first direction of at least about 0.2 m.

11. A method as claimed in claim 1, wherein the base material layer comprises a metallic material.

12. A method as claimed in claim 11, wherein the metallic material comprises aluminum.

13. A method as claimed in claim 1, wherein the surface layer comprises a ceramic material.

14. A method as claimed in claim 1, wherein the particulate coating material comprises $Al_2O_3$.

15. A method as claimed in claim 1, further comprising the step of treating the surface of the surface layer material before application of the image layer, to change its bonding or wetting characteristics or both to the image layer.

16. A method of making a light sensitive printing plate, which comprises:

(a) selecting a particulate coating material having particles of a size less than about 15 μm;

(b) selecting bigger particles having a size bigger than the particles of the particulate coating material;

(c) creating a surface layer on a substrate base material layer by depositing the particulate coating material and the bigger particles on the base material layer using a thermal spraying technique such that the bigger particles form regions of local roughness on the base material layer; and (c) creating an image layer on the deposited surface layer such that the surface layer is located intermediate the base material layer and the image layer.

17. A method as claimed in claim 16, wherein the size of the bigger particles is at least about 1.3 times the size of the particles of the particulate coating material.

18. A method as claimed in claim 16, wherein the size of the bigger particles is at least about 1.8 times the size of the particles of the particulate coating material.

19. A method of making a light sensitive printing plate, which comprises:

(a) selecting a particulate coating material having particles of a size less than about 15 μm;

(b) creating a surface layer on a substrate base material layer by depositing the particulate coating material on the base material layer using a thermal spraying technique while the base material layer is maintained in contact with a heat sink; and (c) creating an image layer on the deposited surface layer such that the surface layer is located intermediate the base material layer and the image layer.

20. A method as claimed in claim 19, wherein the surface layer is deposited on the base material layer by means of a plasma spraying process.

21. A method as claimed in claim 20, wherein the surface layer is deposited on the base material layer in an atmosphere of an inert gas.

22. A method as claimed in claim 21, wherein the inert gas is heated in an electric arc to an elevated temperature of at least $10^{4\circ}$ C.

23. A method as claimed in claim 19, wherein the particulate coating material is selected to have particles of a size less than about 12 μm.

24. A method as claimed in claim 19, wherein the particulate coating material is selected to have particles of a size less than about 8 μm.

25. A method as claimed in claim 19, wherein the particulate coating material is selected to have particles of a size less than about 5 μm.

26. A method as claimed in claim 19, wherein the particulate coating material is selected to have particles of a size from about 2 μm to about 3 μm.

27. A method as claimed in claim 19, wherein the base material layer is in the form of a sheet.

28. A method as claimed in claim 27, wherein the base material layer moves continuously in a first direction and has a width measured in a direction perpendicular to the first direction of at least about 0.2 m.

29. A method as claimed in claim 19, wherein the base material layer comprises a metallic material.

30. A method as claimed in claim 29, wherein the metallic material comprises aluminum.

31. A method as claimed in claim 19, wherein the surface layer comprises a ceramic material.

32. A method as claimed in claim 19, wherein the particulate coating material comprises $Al_2O_3$.

33. A method as claimed in claim 19, further comprising the step of treating the surface of the surface layer material before application of the image layer, to change its bonding or wetting characteristics or both to the image layer.

* * * * *